US008920267B2

(12) United States Patent
Gable

(10) Patent No.: US 8,920,267 B2
(45) Date of Patent: Dec. 30, 2014

(54) THROWING TOY WITH IMPROVED ADJUSTABLE AND TIME FLIGHT MEASUREMENT

(71) Applicant: Derek J. Gable, Rancho Palos Verdes, CA (US)

(72) Inventor: Derek J. Gable, Rancho Palos Verdes, CA (US)

( * ) Notice: Subject to any disclaimer, the term of this patent is extended or adjusted under 35 U.S.C. 154(b) by 70 days.

(21) Appl. No.: 13/654,247

(22) Filed: Oct. 17, 2012

(65) Prior Publication Data

US 2013/0115847 A1 May 9, 2013

Related U.S. Application Data

(60) Provisional application No. 61/555,990, filed on Nov. 4, 2011.

(51) Int. Cl.
*A63B 43/00* (2006.01)

(52) U.S. Cl.
USPC ..... 473/569; 446/34

(58) Field of Classification Search
USPC ..... 446/34; 473/569, 570, 584, 585, 586, 473/613, 614
See application file for complete search history.

(56) References Cited

U.S. PATENT DOCUMENTS

| | | | | | |
|---|---|---|---|---|---|
| 3,198,526 | A | * | 8/1965 | Smith et al. | 473/281 |
| 3,256,020 | A | | 6/1966 | Smith | |
| 3,884,466 | A | | 5/1975 | MacDonald et al. | |
| 4,003,574 | A | | 1/1977 | MacDonald et al. | |
| 4,133,528 | A | | 1/1979 | Koblick | |
| 4,736,948 | A | | 4/1988 | Thomas | |
| 5,000,451 | A | | 3/1991 | MacDonald et al. | |
| 5,066,012 | A | | 11/1991 | Stark | |
| 5,123,645 | A | | 6/1992 | MacDonald et al. | |
| 5,269,514 | A | | 12/1993 | Adler et al. | |
| 5,458,329 | A | * | 10/1995 | Bushman et al. | 473/613 |
| 5,526,326 | A | * | 6/1996 | Fekete et al. | 368/10 |
| 5,779,576 | A | * | 7/1998 | Smith et al. | 473/570 |
| 6,010,419 | A | * | 1/2000 | Rappaport et al. | 473/613 |
| 6,042,494 | A | * | 3/2000 | Rappaport et al. | 473/613 |
| 6,220,918 | B1 | * | 4/2001 | Laronge | 446/63 |
| 6,659,728 | B2 | * | 12/2003 | Bush et al. | 417/44.1 |
| 7,288,037 | B2 | * | 10/2007 | Myers | 473/613 |
| 2003/0027672 | A1 | * | 2/2003 | Leal et al. | 473/613 |
| 2004/0002284 | A1 | * | 1/2004 | Leal et al. | 446/484 |
| 2008/0039250 | A1 | * | 2/2008 | Martino | 473/613 |

* cited by examiner

*Primary Examiner* — Vishu K. Mendiratta
(74) *Attorney, Agent, or Firm* — Fulwider Patton LLP

(57) ABSTRACT

Apparatus and method of adjusting the angle of attack to the longitudinal axis of a plurality of aerodynamic surfaces on a high performance throwing toy which affect the performance of such toy and to also provide a means of measuring such performance by recording the time the toy is airborne during flight.

8 Claims, 4 Drawing Sheets

THROWING TOY WITH IMPROVED ADJUSTABLE AND TIME FLIGHT MEASUREMENT

This application is based upon and claims priority from Provisional Application No. 61/555,990, filed Nov. 4, 2011, incorporated by reference herein.

BACKGROUND OF THE INVENTION

This invention is directed towards an apparatus and method for simultaneously setting the attack angle of a number of aerodynamic surfaces such as fins on a throwing toy. The ability to adjust the angle of attack of such fins greatly affects the performance of such throwing toy and also provides additional play value and marketability.

It is known that the performance of a throwing toy is significantly affected by being spun along its travelling axis when it is thrown, much like a football that is thrown with a spiral. It is also known that most people find it difficult to throw a consistent spiral. It is also known that the direction of the rotation is different when thrown by left handed throwers verses right handed throwers, so that it would be desirable to provide a throwing toy that will spiral consistently when thrown with a direction and degree of rotation that can be adjusted as desired.

One conventional game ball having a shape generally similar to an American football is known that has individually adjustable fins provided on the outside of the ball. However, the individually adjustable fins can be difficult to adjust together to have a common angle of attack with respect to a rotational axis of the game ball to have a consistent spiral.

It would be desirable to provide a throwing toy that can be adjusted to have a consistent spiral about a rotational axis to suit the needs and handedness of the thrower. It would also be desirable to provide such a throwing toy with a timer for monitoring and displaying flight time of the throwing toy when it is thrown. The present invention addresses these and other needs.

SUMMARY OF THE INVENTION

Briefly, and in general terms, the present invention provides for a throwing toy having a leading end, a trailing end, and a longitudinal throwing axis extending along a length of the throwing toy from the leading end to the trailing end of the throwing toy. The throwing toy includes a main body having an elongated, ellipsoidal shape, a leading end and a trailing end, and a fin mounting portion integrally connected to the trailing end of the main body. In a presently preferred aspect, the fin mounting portion is a generally tubular tail portion. The fin mounting portion includes a plurality of fins mounted on the fin mounting portion of the throwing toy, each of the fins having a leading edge, a trailing edge, and a common aerodynamic angle of attack relative to the longitudinal axis. The fins are connected to the fin mounting portion and are configured for rotation of at least one of the leading edge and trailing edge relative to the other of the leading edge and trailing edge.

In a presently preferred aspect, the fins are configured to be rotated simultaneously together to present a plurality of aerodynamic surfaces oriented with the same aerodynamic angle of attack, to cause the toy to rotate about the longitudinal throwing axis when the throwing toy is thrown. The fins can be rotated and set together at a desired aerodynamic angle of attack relative to the longitudinal throwing axis between maximum angles of attack on either side of the longitudinal throwing axis, such as to be rotated at an angle on either side of the longitudinal throwing axis, or to be oriented parallel to the throwing axis, and, for example.

In one presently preferred embodiment, the leading edges of the fins are connected to a common rotatable member, such as a rotatable adjustment ring, for example, that is rotatably connected to the main body, and that in one preferred aspect can extend radially outwardly from the fin mounting portion. In a presently preferred aspect, each of the fins includes a flange or extension extending from the leading edge of the fin that protrudes through a corresponding one of a plurality of holes provided in the rotatable adjustment ring. When the adjustment ring is rotated about the longitudinal throwing axis of the throwing toy, the flanges or extensions protruding into the adjustment ring are caused to correspondingly be rotated and set the angle of all the fins to a new angle of attack, so that when one fin is adjusted all fins are adjusted simultaneously. In another presently preferred aspect, at least a portion of each fin rotates relative to a pivot point on the fin located rearwardly of the flange or extension.

In another presently preferred aspect, an axial tubular bore is defined within the main body and fin mounting portion of the throwing toy, and extends along the longitudinal throwing axis through the throwing toy from the leading end of the main body of the throwing toy to the trailing end of the fin mounting portion of the throwing toy.

In another presently preferred aspect, an internal electronic timer and timer display are disposed in the main body of the throwing toy for measuring, recording and/or displaying the time the throwing toy is in the air after it is thrown and before it is caught or flight is otherwise terminated, such as by hitting the ground. The electronic timer is started when the throwing toy leaves a thrower's hand, and is stopped by sensing the impact when the throwing toy is caught or hits the ground. In a presently preferred embodiment of the invention, the time of flight may be saved as a metric to be compared to other players or one's own performance.

The mechanism for simultaneously setting the angle of the fins allows for a quicker operation of the adjustments for the toy, making play more enjoyable, provides improved accuracy in setting all fins to the same angle for optimum performance, and provides a valuable feature that can be demonstrated in the package, thus providing a strong marketing element. An electronic timer of the throwing toy of the invention for measuring the time the ball is in the air after it is thrown and before it is caught or flight is otherwise terminated also provides improved play value of the throwing toy by providing a metric of performance by a single player that is read out on the toy itself.

The throwing toy of the invention also provides the additional benefits for individual play and improvement, in allowing one or more users to have a play pattern where a player can play individually or with a group of players in a meaningful manner, as they can attempt to improve on their measured performance, and in providing a way of positively measuring and demonstrating the remarkable performance of the throwing toy of the invention.

Other features and advantages of the present invention will become more apparent from the following detailed description of the preferred embodiments in conjunction with the accompanying drawings, which illustrate, by way of example, the operation of the invention.

DETAILED DESCRIPTION OF THE PREFERRED EMBODIMENTS

Figure 1:
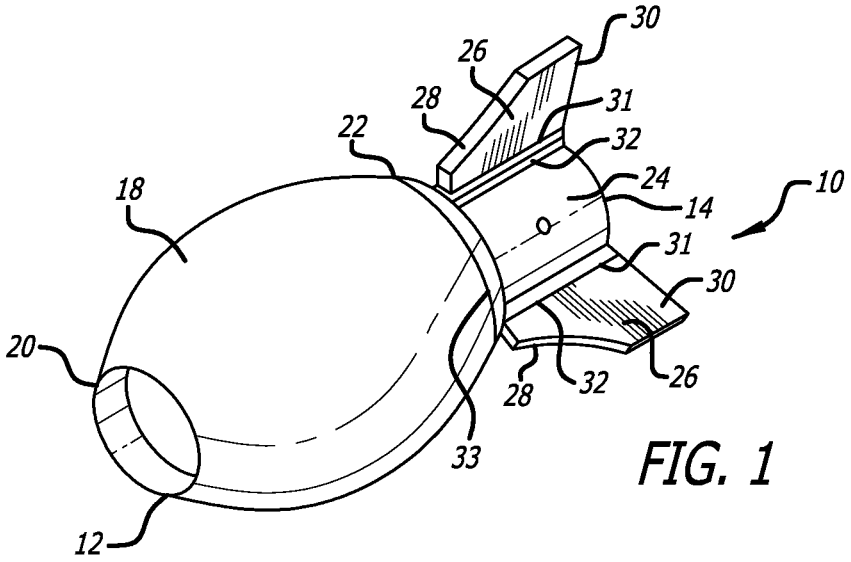
FIG. 1 is a front perspective view of a throwing toy of the present invention.
Figure 2:
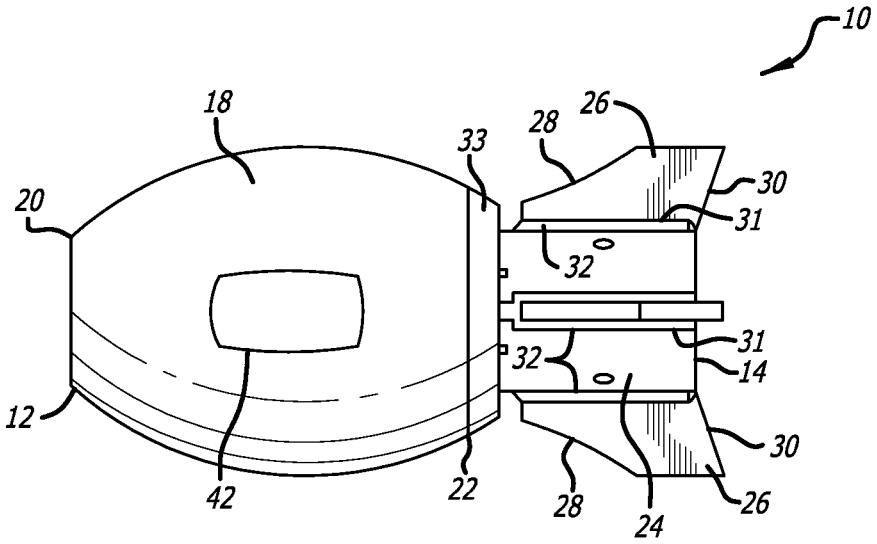
FIG. 2 is a side elevational view of the throwing toy of FIG. 1.
Figure 3:
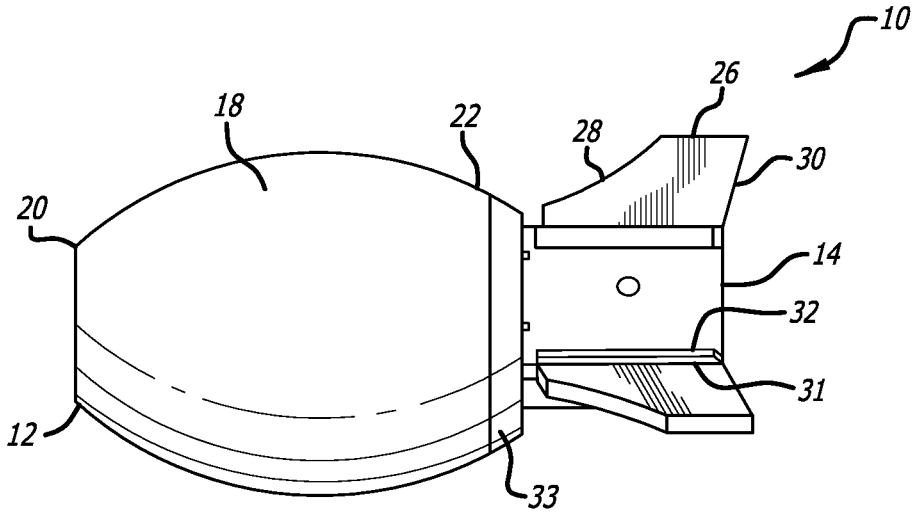
FIG. 3 is a side elevational view of the throwing toy similar to FIG. 2, showing the throwing toy in a rotated position.

With reference to the drawings, which are provided by way of example, for purposes of illustration, and not by way of limitation, the present invention provides for a throwing toy 10 having a leading end 12, a trailing end 14, and a longitudinal throwing axis 16 extending along a length of the throwing toy from the leading end to the trailing end of the throwing toy. The throwing toy includes a main body 18 having an elongated, ellipsoidal shape, a leading end 20 and a trailing end 22, and a fin mounting portion 24 integrally connected to the trailing end of the main body. In a presently preferred aspect, the fin mounting portion is a generally tubular tail portion. The fin mounting portion includes a plurality of fins 26 mounted on the fin mounting portion of the throwing toy, each of the fins having a leading edge 28, a trailing edge 30, and a common aerodynamic angle of attack relative to the longitudinal axis. The fins are connected to the fin mounting portion and are configured for rotation of at least one of the leading edge and trailing edge relative to the other of the leading edge and trailing edge. The fins typically are formed of generally planar pieces of polymeric material or other similar suitable pliable material, and are typically adhered along at least a portion of an inner edge 31 of the fins to the outer surface of the generally tubular tail portion at the trailing end of the throwing toy, such as in slots or fin trays 32, for example.

In a presently preferred aspect, the fins are configured to be rotated simultaneously together to present a plurality of aerodynamic surfaces oriented with the same aerodynamic angle of attack, to cause the toy to rotate about the longitudinal throwing axis when the throwing toy is thrown. The fins can be rotated and set together at a desired angle of attack relative to the longitudinal throwing axis between maximum angles of attack on either side of the longitudinal throwing axis, such as to be in line with the throwing axis and to rotate at an angle on either side of this axis, for example.

Figure 6:
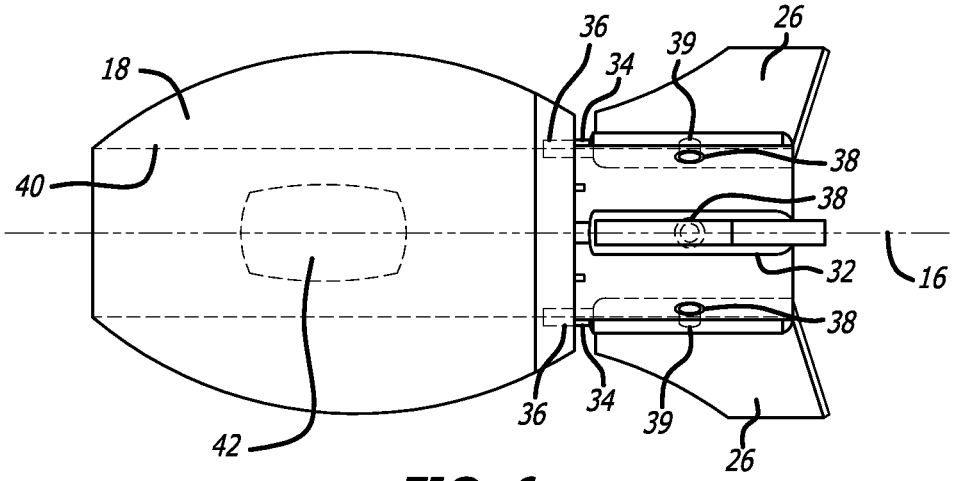
FIG. 6 is an enlarged diagrammatic partial side sectional view of the throwing toy of FIG. 1.
Figure 7:
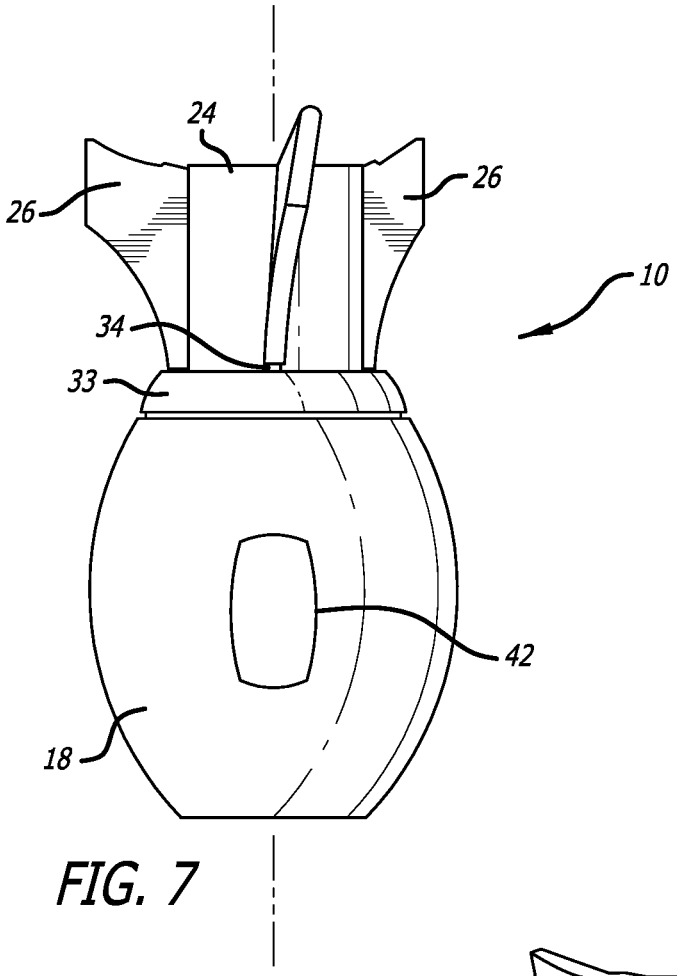
FIG. 7 is a side elevational view of the throwing toy of FIG. 1, illustrating a first aerodynamic angle of attack of the fins in a first rotational position of the rotatable adjustment ring.
Figure 8:
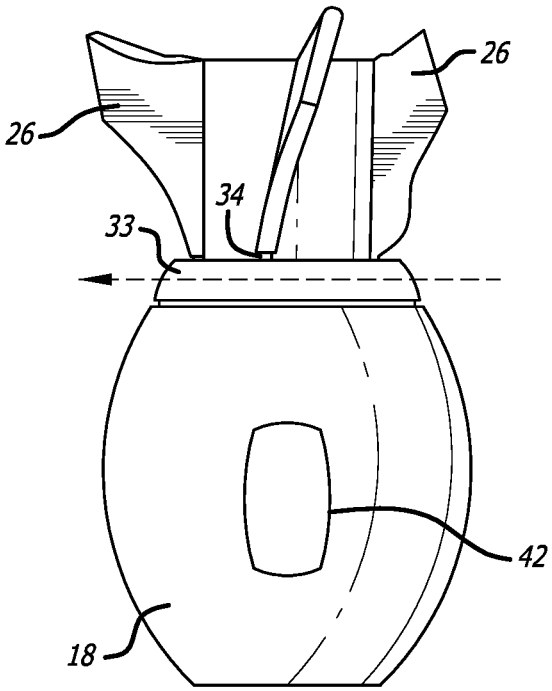
FIG. 8 is a side elevational view of the throwing toy similar to FIG. 7, illustrating a second aerodynamic angle of attack of the fins in a second rotational position of the rotatable adjustment ring.

In one presently preferred embodiment, the leading edges of the fins are connected to a common rotatable member 33, such as a rotatable adjustment ring, for example, that is rotatably connected to the main body, and which in one preferred aspect can extend radially outwardly from the fin mounting portion. The common rotatable member is typically rotatably connected to the main body by a ratchet mechanism, such as a plurality of detents, for example, allowing the common rotatable member to be rotated and set in a desired position relative to the main body and fin mounting portion. Alternatively, the common rotatable member can be similarly rotatably connected to the fin mounting portion to be rotated and set in a desired position relative to the main body and fin mounting portion. In a presently preferred aspect, each of the fins includes a flange or extension 34, best seen in FIGS. 6, 7 and 8, extending from the leading edge of the fin that protrudes through a corresponding one of a plurality of holes 36, shown in FIG. 6, provided in the rotatable adjustment ring, so that each fin rotates about a medial pivot point 38 on the fin located rearwardly of the flange or extension. When the adjustment ring is rotated about the longitudinal throwing axis of the throwing toy, the flanges or extensions protruding into the adjustment ring are caused to correspondingly be rotated and set the angle of all the fins to a new angle of attack, so that when one fin is adjusted all fins are adjusted simultaneously.

Alternatively, the fins can be mounted to the fin mounting portion of the throwing toy by pivot pins extending into the fin mounting portion at medial pivot points, and a mechanism can be provided that connects the pivot pins 39 of each fin with gears, a filament, or the like, so that when one pivot pin is rotated all pivot pins rotate, causing the fins to rotate together. In a presently preferred aspect, a simple locking mechanism such as a lockable tab or detent may additionally be provided on an adjustment ring to prevent movement from a setting until the thrower so desires.

Figure 4:
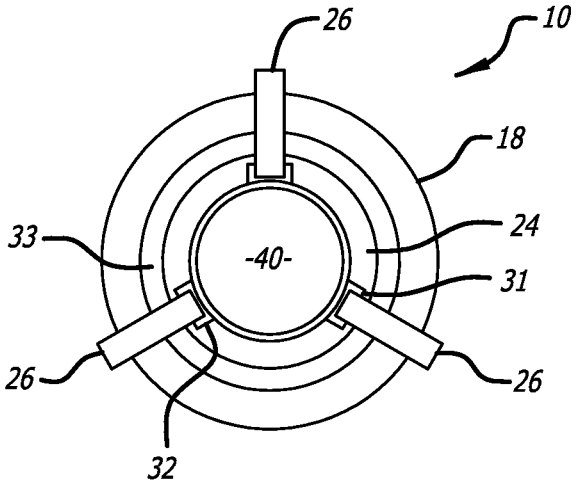
FIG. 4 is a rear view of the throwing toy of FIG. 1.
Figure 5:
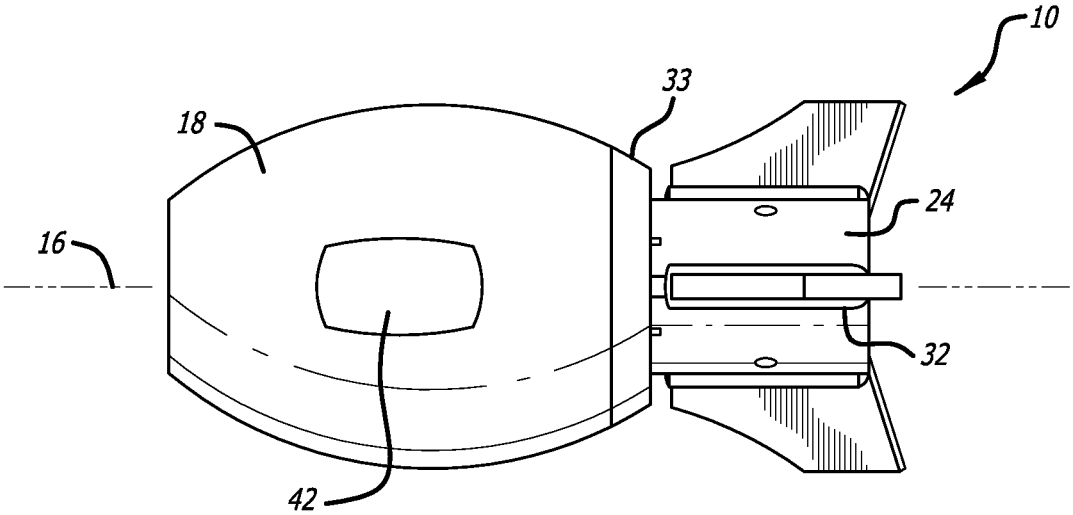
FIG. 5 is an enlarged diagrammatic side elevational view of the throwing toy of FIG. 1.

In another presently preferred aspect, an axial tubular bore 40, shown in FIGS. 4 and 6, is defined within the main body and fin mounting portion of the throwing toy, and extends along the longitudinal throwing axis through the throwing toy from the leading end of the main body of the throwing toy to the trailing end of the fin mounting portion of the throwing toy.

In another presently preferred aspect, the throwing toy includes an internal electronic timer and timer display 42 disposed in the main body of the throwing toy for measuring, recording and/or displaying the time the throwing toy is in the air, the "hang time" after it is thrown and before it is caught or flight is otherwise terminated, such as by hitting the ground. The electronic timer is started when the throwing toy leaves a thrower's hand, and is stopped by sensing the impact when the throwing toy is caught or hits the ground. A device such as a weight on a spring can be used to sense the acceleration when thrown and the deceleration on being caught or hitting the ground. The number displayed can be a multiple of the seconds recorded to make the differential times more determinable and make the numerical impact more dramatic for an individual user who is using the timer and adjustable fins to improve his or her performance.

There are numerous configurations of apparatus within the scope of the invention to adjust the angle of the fins simultaneously including, but not limited to connecting either end of the fins to a common structure or element so that when one fin is adjusted all fins are adjusted, and a mechanism that connects the pivot point of each fin with gears, filament, and the like, so that when one pivot is rotated all pivots rotate.

The invention may be embodied in other forms without departure from the benefits and characteristics described. The embodiments described therefore are to be considered in all respects as illustrative and not restrictive. Although the present invention has been described in terms of certain preferred embodiments, other embodiments that are apparent to those of ordinary skill in the art are also within the scope of the invention. Accordingly, it is not intended that the invention be limited, except as by the appended claims.

What is claimed is:

1. A throwing toy having a leading end, and trailing end and a longitudinal throwing axis extending along a length of the throwing toy, comprising:

a main body having an elongated, ellipsoidal shape, a leading end and a trailing end;

a rotatable adjustment ring rotatably connected to said main body by a ratchet mechanism such that said rotatable adjustment ring is rotatable with respect to said main body;

a fin mounting portion integrally connected to said trailing end of said main body and having an exterior surface, said fin mounting portion extending rearwardly of said main body, said fin mounting portion including a plurality of fins mounted on the exterior surface of said fin mounting portion of the throwing toy, each of said plurality of fins having a leading edge, a trailing edge, and a common aerodynamic angle of attack relative to the longitudinal axis, said leading edges of said fins being connected to said rotatable adjustment ring, and said trailing edges of each of said plurality of fins being connected to the fin mounting portion for rotation of the leading edges of said fins relative to the fin mounting portion and trailing edges of said fins, said leading edges of said plurality of fins being configured to be rotated simultaneously together relative to the fin mounting portion and trailing edges of said plurality of fins to present a plurality of aerodynamic surfaces oriented with the same aerodynamic angle of attack.

2. The throwing toy of claim 1, wherein said fin mounting portion comprises a generally tubular tail portion.

3. The throwing toy of claim 1, wherein said plurality of fins can be rotated and set together at a desired aerodynamic angle of attack relative to the longitudinal throwing axis between maximum angles of attack on either side of the longitudinal throwing axis.

4. The throwing toy of claim 1, wherein said rotatable adjustment ring extends radially outwardly from said fin mounting portion.

5. The throwing toy of claim 1, wherein said rotatable adjustment ring comprises a plurality of holes around a perimeter of said rotatable adjustment ring, and each of said plurality of fins includes a flange extending from the leading edge of the fin that protrudes through a corresponding one of said plurality of holes in said rotatable adjustment ring, wherein when said rotatable adjustment ring is rotated about the longitudinal throwing axis of the throwing toy, the flanges protruding into said rotatable adjustment ring are caused to correspondingly be rotated and set the angle of all the fins to a new angle of attack, whereby when one fin is adjusted all fins are adjusted simultaneously.

6. The throwing toy of claim 1, further comprising an axial tubular bore defined within the main body and fin mounting portion of the throwing toy, and extending along the longitudinal throwing axis through the throwing toy from the leading end of the main body of the throwing toy to the trailing end of the fin mounting portion of the throwing toy.

7. The throwing toy of claim 1, further comprising an electronic timer disposed in the main body of the throwing toy for measuring a period of time the throwing toy is in the air after it is thrown and before flight of the throwing toy is otherwise terminated.

8. The throwing toy of claim 7, further comprising a timer display connected to said electronic timer disposed in the main body of the throwing toy.

* * * * *